US008678377B2

(12) United States Patent
Kurokawa

(10) Patent No.: US 8,678,377 B2
(45) Date of Patent: Mar. 25, 2014

(54) SHEET CONVEYING DEVICE

(71) Applicant: Kotaro Kurokawa, Ichinomiya (JP)

(72) Inventor: Kotaro Kurokawa, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/776,915

(22) Filed: Feb. 26, 2013

(65) Prior Publication Data

US 2013/0228964 A1 Sep. 5, 2013

(30) Foreign Application Priority Data

Mar. 5, 2012 (JP) ..... 2012-048126

(51) Int. Cl.
*B65H 3/52* (2006.01)

(52) U.S. Cl.
USPC ..... 271/121

(58) Field of Classification Search
USPC ..... 271/121
See application file for complete search history.

(56) References Cited

U.S. PATENT DOCUMENTS 4,887,806 A * 12/1989 Tanaka et al. ..... 271/121
5,537,227 A * 7/1996 Samii et al. ..... 358/498
5,573,338 A * 11/1996 Morikawa et al. ..... 400/611
5,718,424 A * 2/1998 Nakatani et al. ..... 271/121
5,718,425 A * 2/1998 Veigl ..... 271/121
6,010,126 A * 1/2000 Mou et al. ..... 271/121
7,618,036 B2 * 11/2009 Ikeda ..... 271/121
7,841,592 B2 * 11/2010 Wu et al. ..... 271/121
7,845,630 B2 * 12/2010 Hung et al. ..... 271/121
8,302,958 B2 * 11/2012 Sheng ..... 271/121
8,496,241 B2 * 7/2013 Osakabe et al. ..... 271/121

FOREIGN PATENT DOCUMENTS

JP 60-178136 A 9/1985
JP 06-227693 A 8/1994
JP 07-187423 A 7/1995
JP 07-257768 A 10/1995
JP 07-257769 A 10/1995

* cited by examiner

*Primary Examiner* — Kaitlin Joerger
(74) *Attorney, Agent, or Firm* — Banner & Witcoff, Ltd.

(57) ABSTRACT

A holding member holds a separation pad configured to separate sheets conveyed by a roller one by one, and a roller pressing member. A pressing mechanism is disposed on an opposite side of the separation pad from the roller. The holding member is configured to move relative to the roller between a distant position and a close position in which the holding member is closer to the roller than in the distant position. The pressing mechanism is configured to press the separation pad against the roller when the holding member is in the close position. When the holding member is in the distant position, at least a roller contacting portion of the roller pressing member is retracted from a first surface of the separation pad in a direction away from the roller. The first surface of the separation pad faces the roller.

17 Claims, 7 Drawing Sheets

SHEET CONVEYING DEVICE

CROSS REFERENCE TO RELATED APPLICATION

This application claims priority from Japanese Patent Application No. 2012-048126, filed on Mar. 5, 2012, the entire disclosure of which is incorporated herein by reference.

BACKGROUND OF THE INVENTION

1. Field of the Invention

The present invention relates to a sheet conveying device.

2. Description of Related Art

A known sheet conveying device is configured to convey sheets from a tray while separating the sheets one by one, and comprises a convey roller, a separation pad disposed opposite to the convey roller, and a sheet pressing member, such as a leaf spring, configured to press the sheet against the convey roller.

In such a sheet conveying device, it is preferable to periodically clean a friction surface of the separation pad so that the sheet conveying device can perform stable sheet conveyance. The friction surface of the separation pad is brought into contact with a sheet so as to apply conveyance resistance to the sheet.

SUMMARY OF THE INVENTION

Therefore, a need has arisen for a sheet conveying device that provides an improved workability of cleaning a separation pad.

According to an embodiment of the invention, a sheet conveying device comprises a roller configured to convey sheets in a sheet conveying direction, a separation pad disposed opposite to the roller and configured to separate the sheets one by one, a pressing mechanism disposed on an opposite side of the separation pad from the roller and configured to press the separation pad against the roller, a roller pressing member comprising a roller contacting portion configured to contact and press the roller, and a holding member which holds the separation pad and the roller pressing member. The holding member is configured to move relative to the roller between a distant position and a close position in which the holding member is closer to the roller than in the distant position. The pressing mechanism is configured to press the separation pad against the roller when the holding member is in the close position. The roller pressing member is configured such that when the holding member is in the distant position, at least the roller contacting portion of the roller pressing member is retracted from a first surface of the separation pad in a direction away from the roller. The first surface of the separation pad faces the roller.

Other objects, features, and advantages will be apparent to persons of ordinary skill in the art from the following detailed description of the invention and the accompanying drawings.

BRIEF DESCRIPTION OF THE DRAWINGS

For a more complete understanding of the invention, the needs satisfied thereby, and the features and technical advantages thereof, reference now is made to the following descriptions taken in connection with the accompanying drawings.

DETAILED DESCRIPTION OF EMBODIMENTS

Embodiments of the invention and their features and technical advantages may be understood by referring to FIGS. 1-7B, like numerals being used for like corresponding parts in the various drawings.

According to a first embodiment of the invention, a sheet conveying device is applied to a multi-function device having a facsimile function, a copying function, and a printing function.

Figure 1:
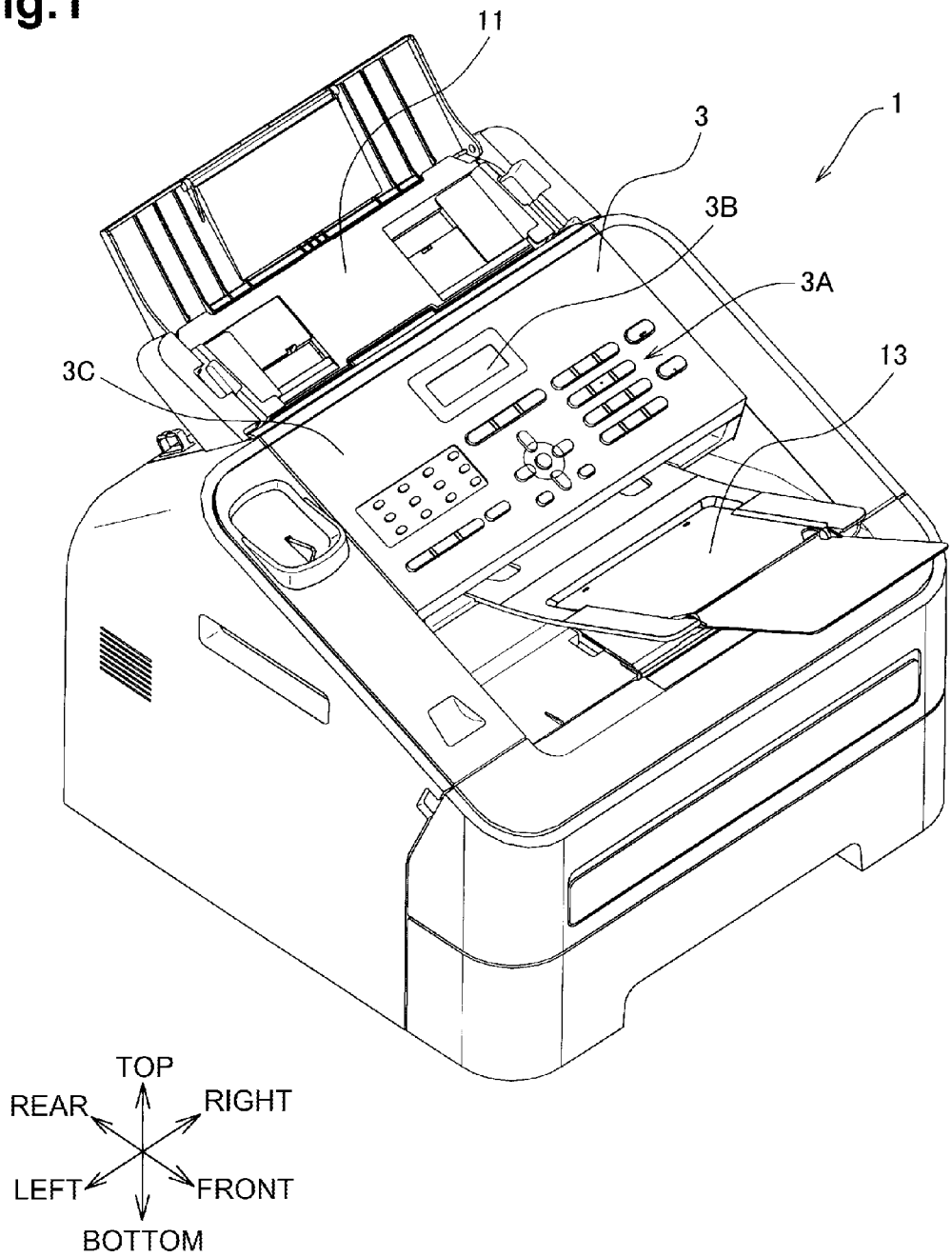
FIG. 1 is a perspective view of a multi-function device comprising a sheet conveying device, according to a first embodiment of the invention.

As shown in FIG. 1, a multi-function device 1 according to the embodiment includes an operation panel 3C on an inclined surface 3 provided on the upper face of the multi-function device 1. The operation panel 3C includes an operation unit 3A and a display 3B. The operation unit 3A is a portion to be operated by a user for utilizing the facsimile and copying functions. The display 3B serves to notify various types of information to the user.

Figure 2:
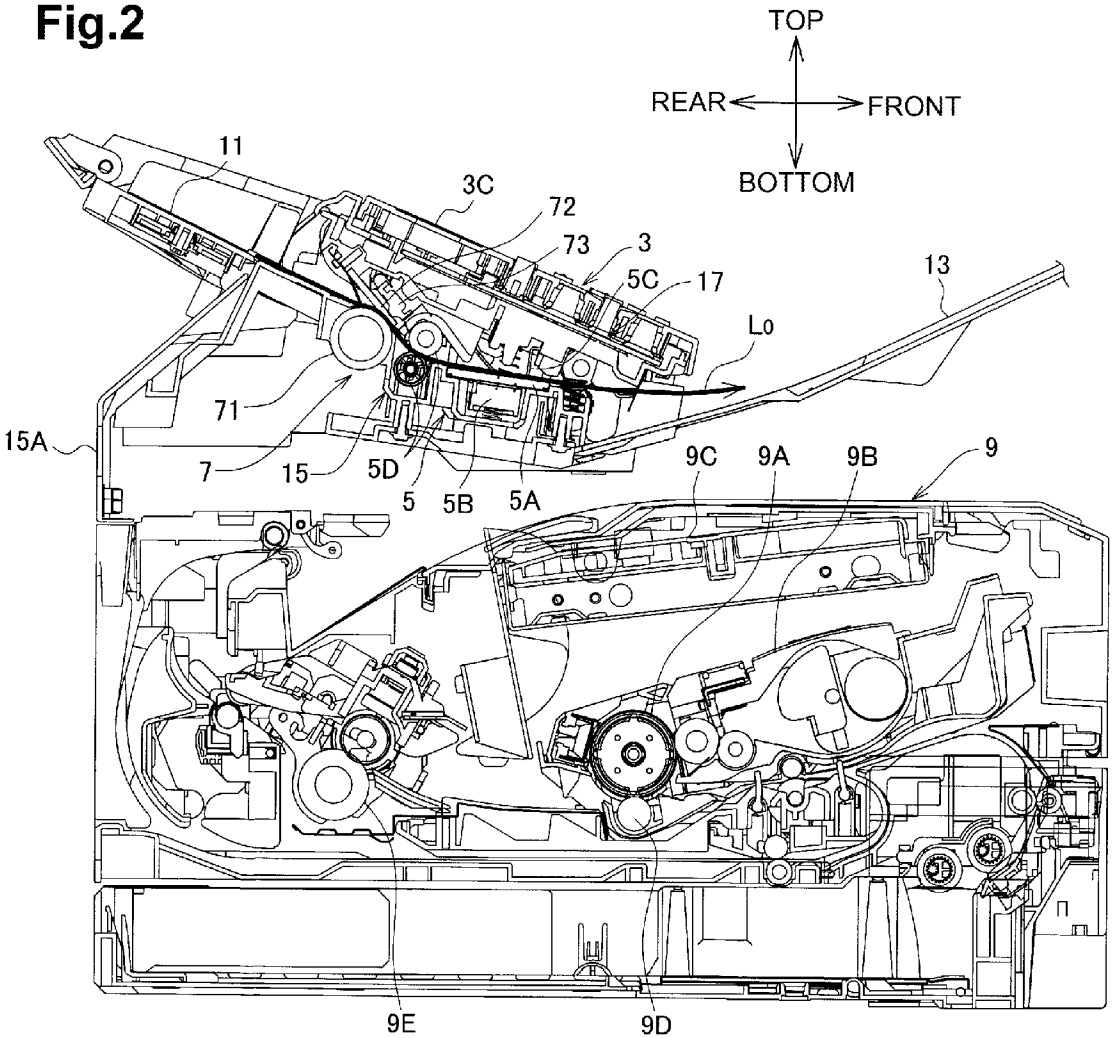
FIG. 2 is a center cross-sectional view of the multi-function device of FIG. 1.

Referring to FIG. 2, a scanning unit 5 that reads information, such as characters and images, on a document sheet is provided below the operation panel 3C. The scanning unit 5 is activated when the facsimile function or the copying function is performed. In this embodiment, the sheet conveying device is applied to an automatic document feeder 7 that feeds document sheets to the scanning unit 5.

An image forming unit 9 that forms an image on a sheet, e.g., a recording sheet, is provided below the scanning unit 5 and the automatic document feeder 7, with a clearance therebetween. The image forming unit 9 prints facsimile data received through a telephone line, or print data transmitted from a computer or the like, on the sheet.

In this embodiment, the image forming unit 9 is an electrophotographic image forming unit configured to form an image on the sheet by transferring a developing agent onto the sheet. To be more specific, the image forming unit 9 includes a developing unit 9B having a photosensitive drum 9A, an exposure unit 9C that exposes the photosensitive drum 9A to light, a transfer member 9D that transfers a developer image carried by the photosensitive drum 9A to the sheet, and a fixing unit 9E that heats the developing agent to thereby fix the transferred developer image onto the sheet.

In this embodiment, as shown in FIG. 2, a sheet, e.g., a document sheet is conveyed from a document tray 11 provided on the rear side of the multi-function device 1 toward an output tray 13 provided on the front side of the multi-function device 1. The automatic document feeder 7 is located upstream of the scanning unit 5 in the sheet conveying direction.

The automatic document feeder 7 separates, one by one, a plurality of document sheets stacked on the document tray 11 and feeds each of the document sheets to the scanning unit 5. The scanning unit 5 reads information, such as characters, on the document sheet conveyed by the automatic document feeder 7 toward the output tray 13. The document sheet that has been read is sequentially stacked on the output tray 13.

The scanning unit 5 includes a platen 5A, an image sensor 5B, a document presser 5C, and a pair of convey rollers 5D. The platen 5A is a transparent member that supports the document sheet from below. The image sensor 5B is, for example, a contact image sensor (CIS) that converts light reflected by the document sheet into an electrical signal. The document presser 5C presses the conveyed document sheet against the platen 5A. The pair of convey rollers 5D is located upstream of the platen 5A in the sheet conveying direction and is configured to convey the document sheet.

A conveying path Lo for the document sheet is defined by a base member 15 and a holding member 17, provided on one side of the conveying path Lo and on the other side thereof, respectively. In other words, the base member 15 and the holding member 17 are disposed opposite to each other in a direction perpendicular to the sheet surface, thereby forming the conveying path Lo.

The base member 15 is fixed to the image forming unit 9 via a joint portion 15A. The holding member 17 is swingably attached to the base member 15 so as to move closer to and away from the base member 15.

Figure 3:
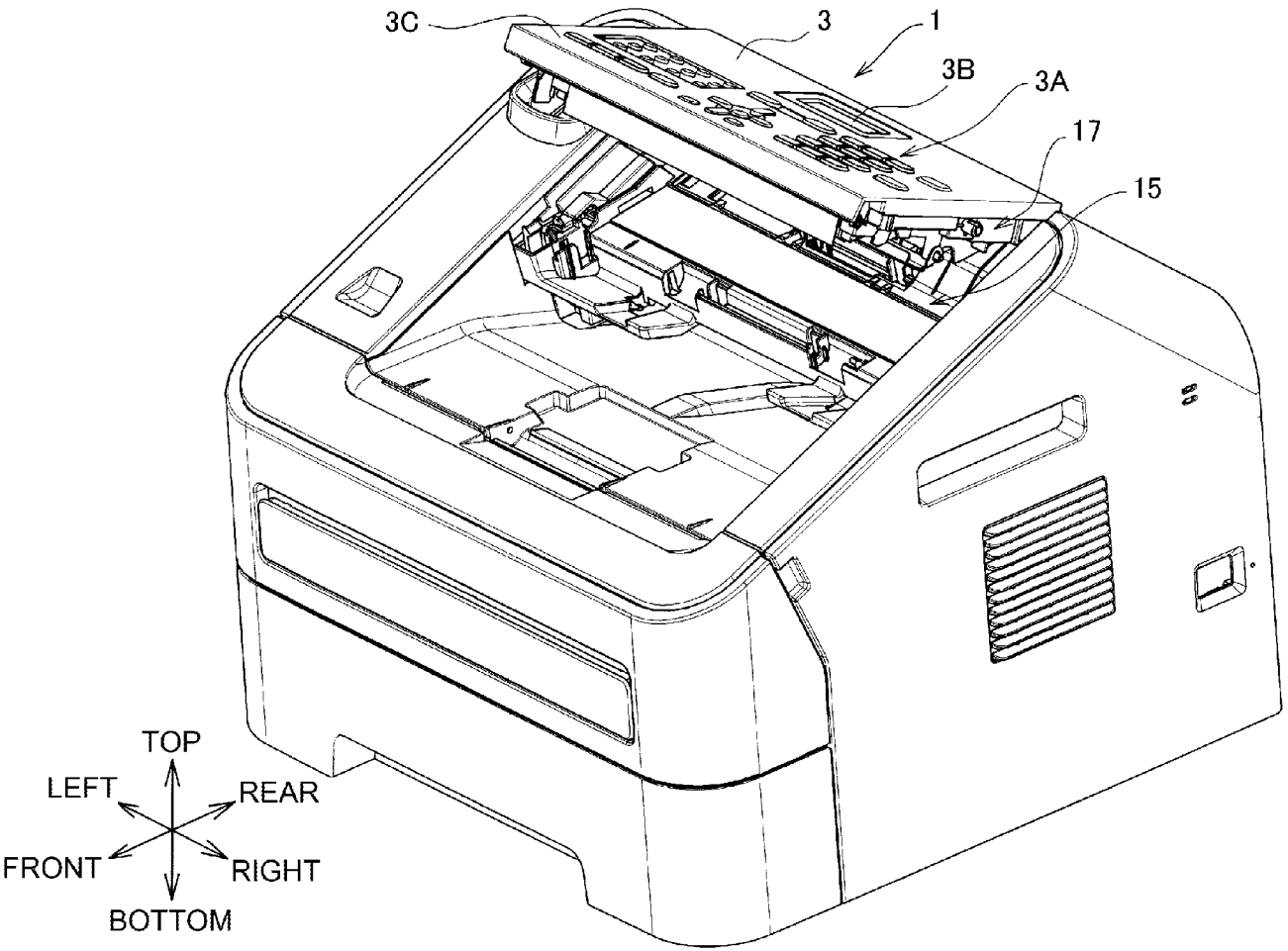
FIG. 3 is a perspective view of the multi-function device of FIG. 1.

To be more specific, the holding member 17 is configured to swing between a close position shown in FIG. 2 in which the holding member 17 is close to the base member 15 and covering the conveying path Lo and a distant position shown in FIG. 3 in which the holding member 17 is distant from the base member 15 and opening the conveying path Lo.

Here, FIG. 3 illustrates a state where the document tray 11 is accommodated inside the multi-function device 1 and the output tray 13 is removed from the multi-function device 1. In contrast, FIG. 2 illustrates a state where the document tray 11 extended outwardly from the multi-function device 1 and the output tray 13 is attached to the multi-function device 1.

The platen 5A, the image sensor 5B, and one of the pair of convey rollers 5D are supported by the base member 15. The document presser 5C and the other of the pair of convey rollers 5D are supported by the holding member 17. Accordingly, the conveying path Lo is opened by moving the holding member 17 into the distant position, and therefore the document sheet jammed in the conveying path Lo can be easily removed.

As shown in FIG. 2, a surface of the document tray 11 is inclined with respect to the horizontal direction. Document sheets to be fed to the scanning unit 5 are stacked on the document tray 11 in the top-bottom direction. Accordingly, the sheets placed on the document tray 11 are caused to move to the lower end of the document tray 11 by the gravity exerted on the document sheets.

A separation roller 71 is provided at the lower end of the document tray 11 and on the lower side in the stacking direction of the document sheets. The separation roller 71 rotates in contact with one or more document sheets and applies conveying force to the document sheets. The separation roller 71 is assembled into the base member 15 and driven to rotate by an electric motor, which is not shown in FIG. 2.

In addition, a separation pad 72 is provided on the upper side in the stacking direction of the document sheets. The separation pad 72 makes contact with one or more documents sheets to apply conveyance resistance thereto. The separation pad 72 makes contact with the document sheets at the position opposite to the separation roller 71. The separation pad 72 is made of an elastically deformable material, such as silicone rubber or urethane rubber, having a relatively high friction coefficient against a document sheet made of paper or the like.

The separation pad 72 is formed in a strip shape extending from the contact portion with the document sheets to the upstream side in the conveying direction, and the upstream end portion of the separation pad 72 in the conveying direction is fixed to the holding member 17. The downstream end portion of the separation pad 72 in the conveying direction is moved closer to and away from the separation roller 71, and is brought into contact with the document sheets while absorbing the variation in thickness of the document sheets.

Figure 5A:
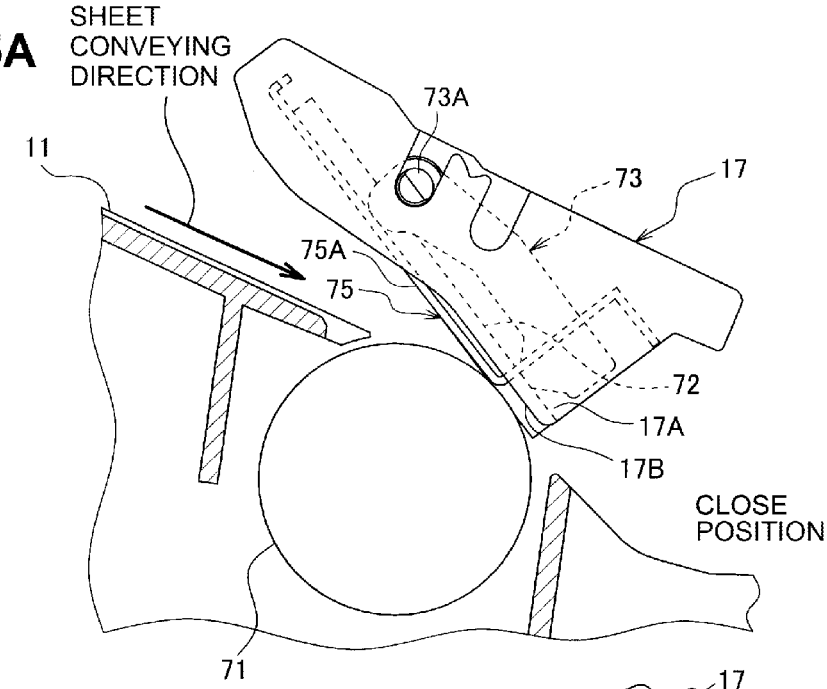
FIGS. 5A and 5B are schematic diagrams showing the structure of the sheet conveying device according to the first embodiment of the invention.
Figure 5B:
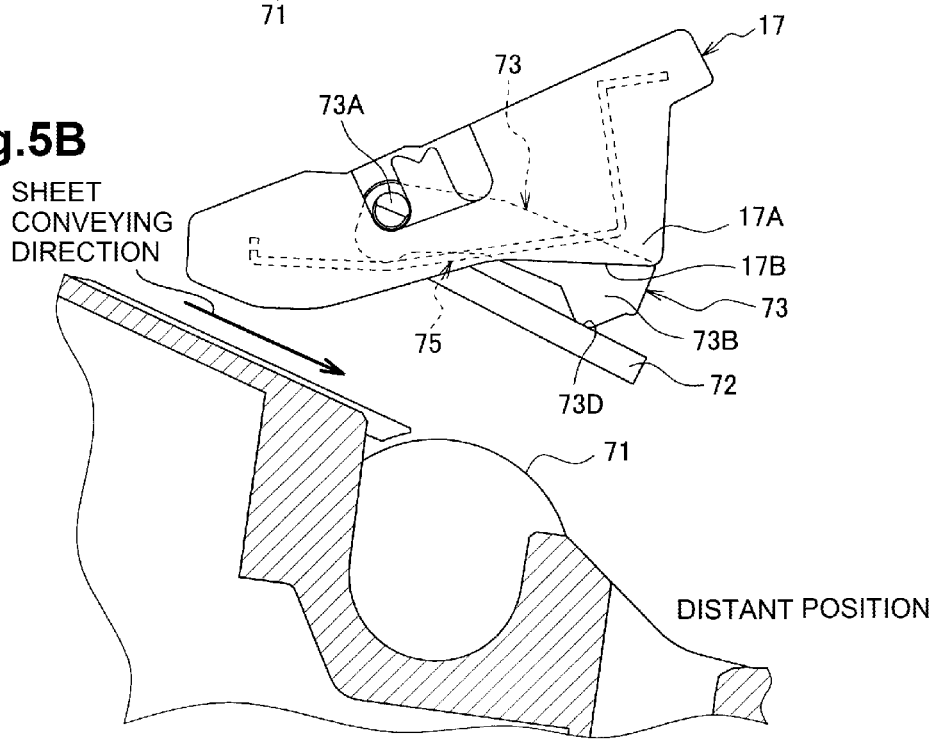

In addition, a pressing member 73 that is movable relative to the separation roller 71 is disposed on an opposite side of the separation pad 72 from the separation roller 71. As shown in FIGS. 5A and 5B, the pressing member 73 is pivotably held by the holding member 17 via a shaft 73A.

Figure 4A:
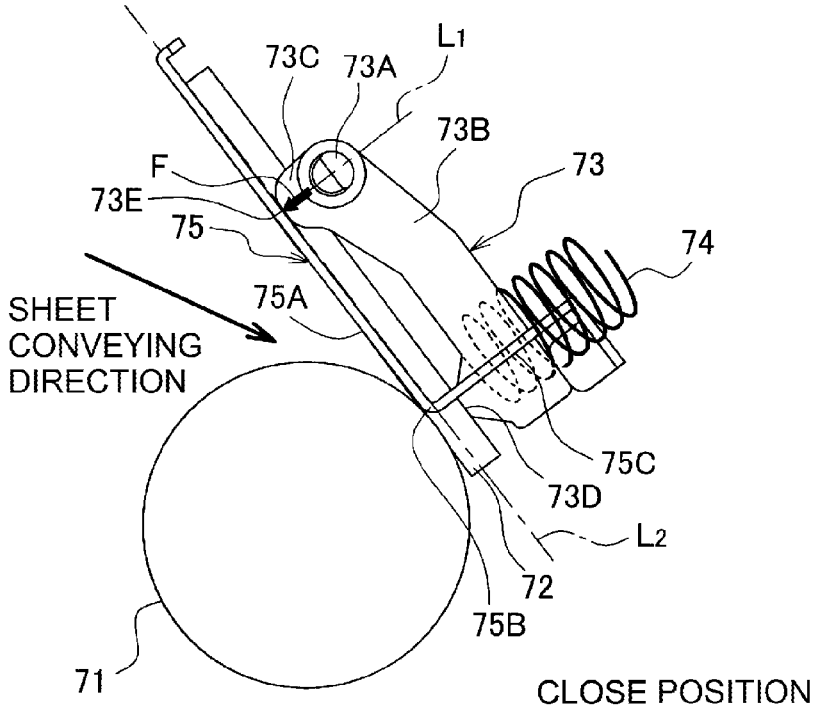
FIGS. 4A and 4B are schematic diagrams showing the structure of the sheet conveying device according to the first embodiment of the invention.
Figure 4B:
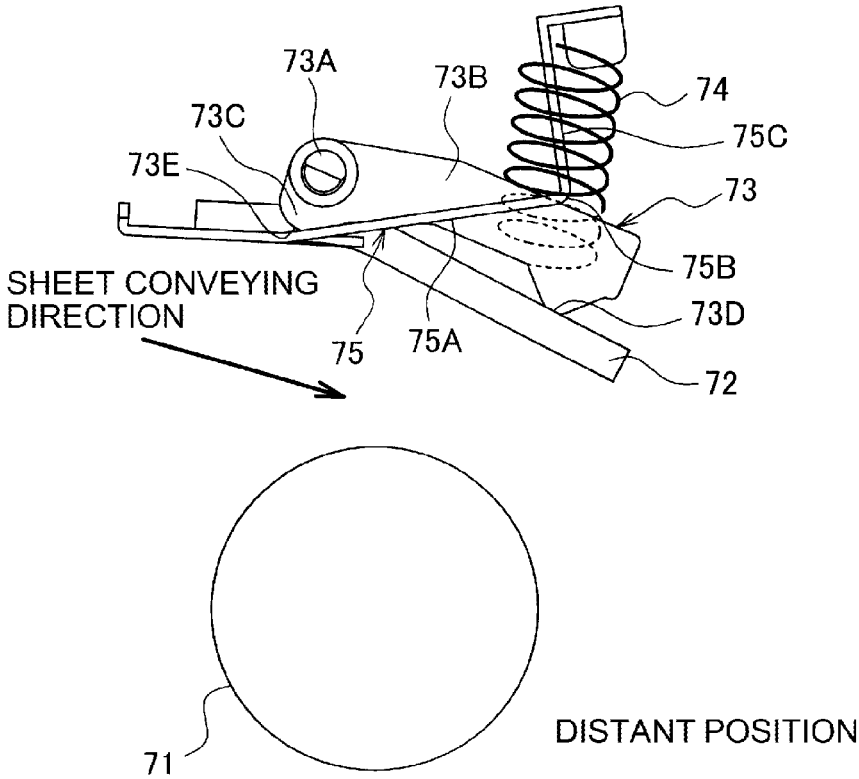

As shown in FIGS. 4A and 4B, the pressing member 73 includes a main body 73B extending from the shaft 73A to the downstream side in the sheet conveying direction, and a pair of pressing arms 73C each extending from the shaft 73A toward a corresponding one of a pair of sheet pressing members 75. The axial direction of the shaft 73A and the rotational axis of the separation roller 71 are parallel to each other. Hereinafter, the direction parallel to the rotational axis of the separation roller 71 will also be referred to as a width direction.

Figure 6:
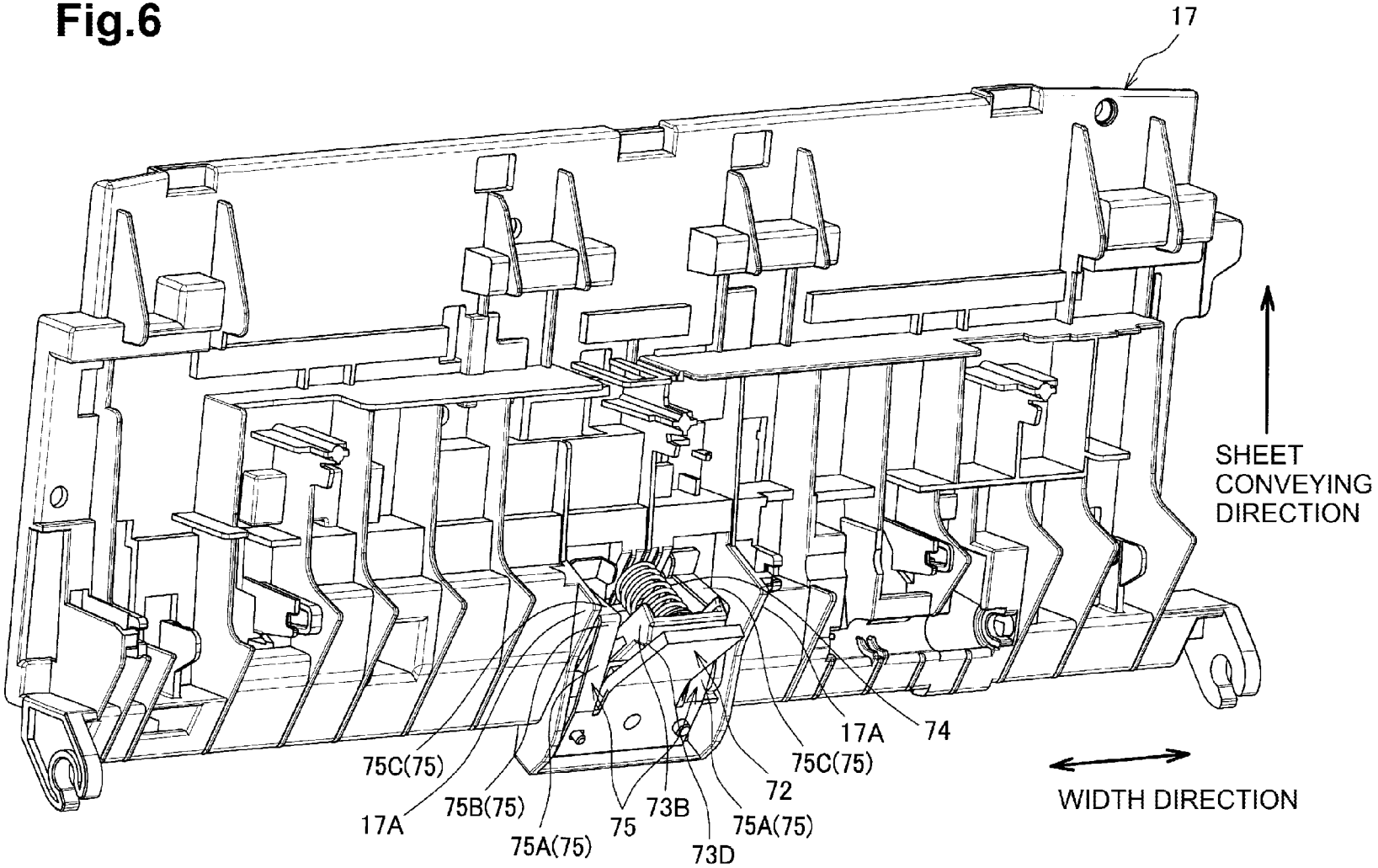
FIG. 6 is a view of a holding member and a pressing mechanism according to the first embodiment of the invention.

The sheet pressing members 75 are provided on respective sides of the separation pad 72 in the width direction as shown in FIG. 6. Each of the sheet pressing members 75 includes a leaf spring portion 75A and an extending portion 75C as shown in FIGS. 4A and 4B. The leaf spring portion 75A is fixed, on the upstream side thereof in the sheet conveying direction, to the holding member 17, and extends from the fixed upstream side to the downstream side such that the end in the extending direction reaches the separation roller 71. The sheet pressing member 75 is an example of a roller pressing member and is configured to, when the holding member 17 is in the close position, contact and press the document sheet conveyed from the document tray 11 against the separation roller 71 or to contact and press the separation roller 71 when no document sheet is placed on the document tray 11.

A contact portion 75B for pressing the document sheet against the separation roller 71 is provided at the end of the leaf spring portion 75A in the extending direction. The extending portion 75C is formed so as to extend from the contact portion 75B in the direction intersecting the extending direction of the leaf spring portion 75A, away from the separation roller 71. In this embodiment, the sheet pressing members 75 are bent in a substantially L-shape when viewed in the width direction.

The main body 73B includes a first contact portion 73D formed on an end portion thereof in the extending direction and configured to contact, a second surface, e.g., a back surface of the separation pad 72. The first contact portion 73D is formed at the protruding end of a protrusion protruding from toward the separation pad 72 and formed along the width direction of the main body 73B. Here, the back surface of the separation pad 72 is opposite from a first surface, e.g., a main surface of the separation pad 72. The main surface of the separation pad 72 faces the separation roller 71, and the back surface of the separation pad 72 faces away from the separation roller 71.

A second contact portion 73E is formed on an extending end of each pressing arm 73C and is configured to contact a corresponding one of the leaf spring portions 75A. In other words, the pressing arm 73C extends from the shaft 73A toward the corresponding leaf spring portion 75A, and the extending end of the pressing arm 73C serves as the second contact portion 73E.

Here, the pressing arms 73C are provided on respective sides of the separation pad 72 in the width direction. The pressing arms 75 are also provided near the shaft 73A, on respective sides of the main body 73B in the width direction.

As shown in FIG. 6, a central portion of the main body 73B in the width direction, which is provided on the side opposite from the first contact portion 73D, is in contact with one end of an elastic member 74, such as a coil spring, in the deforming direction. The elastic member 74 is located between the main body 73B and the holding member 17, to thereby press the first contact portion 73D against the separation pad 72. The other end of the elastic member 74 in the compressing direction is in contact with the central portion of the holding member 17 in the width direction. The pressing member 73 and the elastic member 74 are an example of a pressing mechanism.

As shown in FIGS. 2, 3, 5A and 5B, the holding member 17, which holds the pressing member 73, the separation pad 72, and the sheet pressing member 75, is configured to move relative to the separation roller 71 between the close position and the distant position. The holding member 75 in the close position shown in FIGS. 2 and 5A is closer to the separation roller 71 than the holding member 75 in the distant position shown in FIGS. 3 and 5B is to the holding member 75.

As shown in FIG. 5A, when the holding member 17 moves from the distant position to the close position, the pressing member 73 moves toward the separation roller 71 such that the separation roller 71 presses the pressing member 73 via the separation pad 72.

Accordingly, when the holding member 17 moves from the distant position to the close position, i.e., when the holding member 17 rotates clockwise in FIG. 5B, the pressing member 73 rotates counterclockwise about the shaft 73A, relative to the holding member 17.

Therefore the pressing arm 73C also rotates counterclockwise about the shaft 73A relative to the holding member 17, and the second contact portion 73E projects toward the leaf spring portion 75A so as to press the leaf spring portion 75A against the separation roller 71. At the same time, the elastic member 74 is compressed so as to exert a pressing force onto the separation pad 72.

On the other hand, when the holding member 17 moves from the close position to the distant position, i.e., when the holding member 17 rotates counterclockwise in FIG. 5A, the separation pad 72 moves away from the separation roller 71 and hence the elastic member 74 is decompressed. At the same time, the pressing member 73 rotates clockwise relative to the holding member 17.

Accordingly, the pressing arm 73C also rotates clockwise about the shaft 73A, and therefore the second contact portion 73E refracts relative to the separation roller 71 in a direction away from the separation roller 71 thereby to reduce the pressing force imposed on the leaf spring portion 75A. The leaf spring portion 75A is restored such that at least the contact portion 75B of the leaf spring portion 75A retracts from the main surface of the separation pad 72 in a direction away from the separation roller 71.

In short, in this embodiment, when the holding member 17 is in the distant position and the pressing force imposed on the leaf spring portion 75A is reduced or eliminated, at least a portion of the sheet pressing member 75, i.e., the contact portion 75B of the leaf spring portion 75A configured to make contact with the document sheet, is refracted from the main surface of the separation pad 72 toward the back surface thereof. In other words, when the holding member 17 moves from the close position to the distant position relative to the separation roller 71, the sheet pressing member 75 and the separation pad 72 pivot in opposite directions relative to the holding member.

Then when the holding member 17 is in the close position, the second contact portion 73E presses the leaf spring portion 75A toward the separation roller 7 such that the sheet pressing member 75 exerts a pressing force onto the document sheet.

In this embodiment, as shown in FIG. 4A, when the holding member 17 is in the close position, the pressing member 73 is formed such that a first imaginary line L1 and a second imaginary line L2 is substantially perpendicular to each other.

Here, the first imaginary line L1 passes through a contact point between the second contact portion 73E and the sheet pressing member 75, and through an axial center of the shaft 73A. The second imaginary line L2 passes through the contact point between the second contact portion 73E and the sheet pressing member 75, and through a point which corresponds to a contact point between the sheet pressing member 75 and the separation roller 71 and lies on a back surface of the sheet pressing member 75. The back surface of the sheet pressing member 75 faces away from the separation roller 71.

In addition, as shown in FIG. 6, the holding member 17 includes a pair of wall-shaped ribs 17A formed on respective sides of the sheet pressing member 75 in the width direction, so as to project toward the separation roller 71. As shown in FIG. 5B, when the holding member 17 is in the distant position, the ends 17B of the ribs 17A on the side of the separation roller 71 are located closer to the separation roller 71 than the sheet pressing members 75 are to the separation roller 71.

As shown in FIG. 5A, when the holding member 17 is in the close position, the lower end 17B of each rib 17A is substantially parallel to the leaf spring portion 75A. Accordingly, when the holding member 17 is in the close position, the pair of ribs 17A serve as a guide to guide the document sheet placed on the document tray 11 to the contact point between the separation roller 71 and the separation pad 72.

In the above-described embodiment, at least a portion of the sheet pressing member 75 configured to make contact with the document sheet, i.e., the contact portion 75B of the leaf spring portion 75A, is retracted from the main surface of the separation pad 72 toward the back surface side thereof when the holding member 17 is in the distant position, thereby to allow cleaning of the separation pad 72. Such a configuration prevents interference between a cleaning cloth or the like and the sheet pressing member 75 during the cleaning work, thus improving the efficiency of the cleaning work.

In addition, in the above-described embodiment, the first imaginary line L1 and the second imaginary line L2 are substantially perpendicular to each other when the holding member 17 is in the close position. Accordingly, the rotational axis of the pressing member 73 intersects with the line of action of the pressing force F of the second contact portion 73E imposed on the leaf spring portion 75A, and hence the pressing member 73 is exempted from being subjected to a rotative force, such as a bending moment. This allows the pressing member 73, i.e., the second contact portion 73E to efficiently press the sheet pressing member 75.

The pressing force F generated when the holding member 17 is in the close position, i.e., the force with which the sheet pressing member 75 presses the document sheet, originates from the configuration that the distance between the second contact portion 73E and the shaft 73A is larger than the distance between the leaf spring portion 75A and the shaft 73A. Accordingly, the force necessary for maintaining the holding member 17 in the close position is the sum of the pressing force F and the elastic force of the compressed elastic member 74.

In the above-described embodiment, the holding member 17 includes the pair of wall-shaped ribs 17A formed on both sides of the sheet pressing member 75 in the width direction, so as to project toward the separation roller 71. The ends of the ribs 17A on the side of the separation roller 71 are located closer to the separation roller 71 than the sheet pressing members 75 are to the separation roller 71, at least when the holding member 17 is in the distant position.

Accordingly, when the holding member 17 is in the distant position, the pair of ribs 17A serve as walls enclosing the sheet pressing members 75 therebetween in the width direction. Such a configuration reliably prevents interference between a cleaning cloth or the like and the sheet pressing members 75 during the cleaning work, thus improving the efficiency of the cleaning work.

Figure 7A:
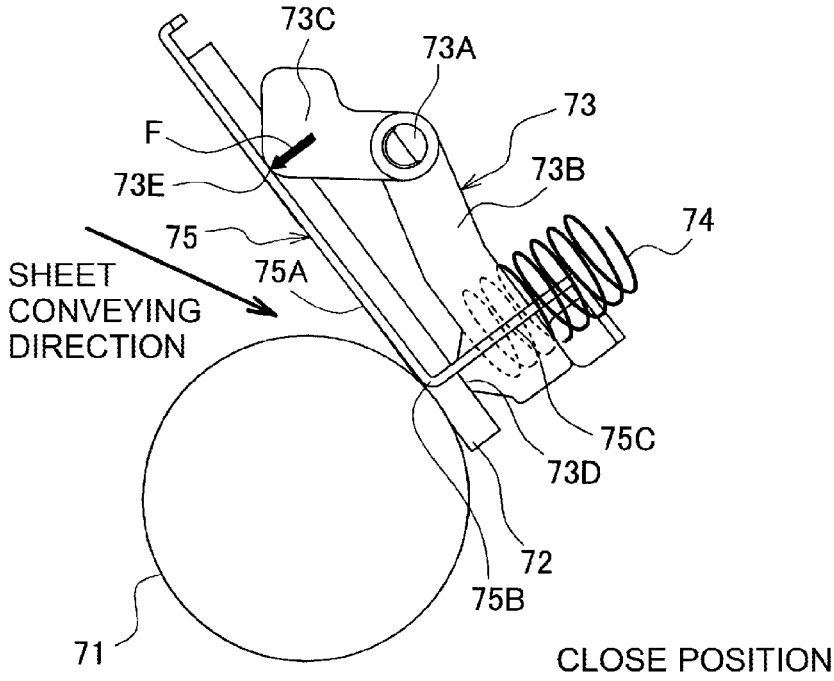
FIGS. 7A and 7B are schematic diagrams showing the structure of a sheet conveying device according to a second embodiment of the invention.
Figure 7B:
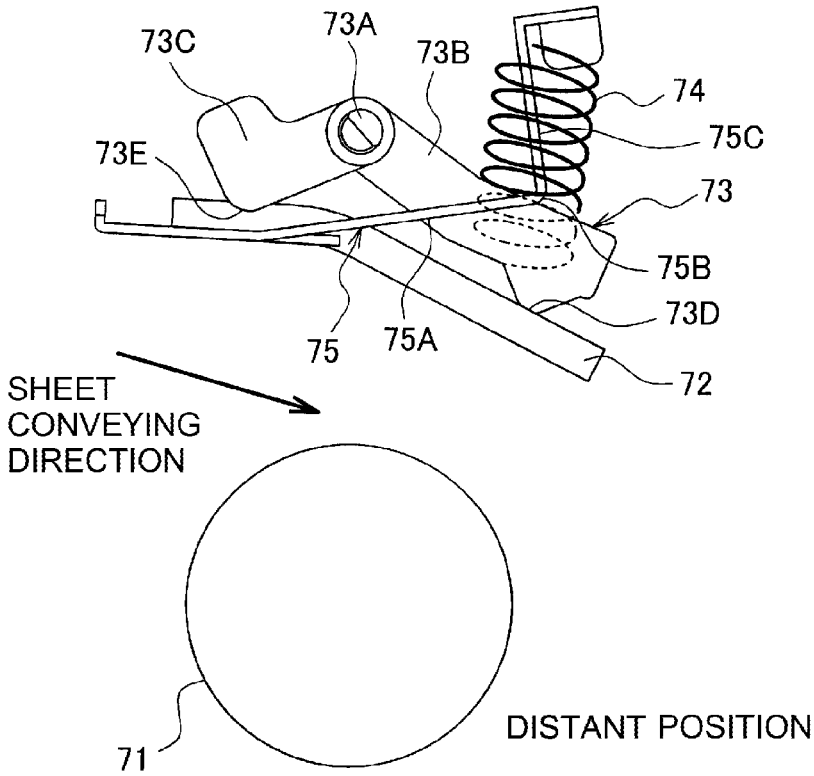

In the sheet pressing member 75 according to the first embodiment, the leaf spring portion 75A and the pressing arm 73C of the pressing member 73 are substantially perpendicular to each other. Alternatively, in a second embodiment, as shown in FIGS. 7A and 7B, a pressing arm 73C extends from a shaft 73A to the upstream side in the sheet conveying direction. Thus, in this embodiment the first imaginary line L1 and the second imaginary line L2 are not perpendicular to each other when a pressing member 73 is viewed in the width direction.

In the foregoing embodiments, the sheet pressing member 75 is configured such that the leaf spring portion 75A is refracted from the main surface of the separation pad 72 toward the back surface thereof when the holding member 17 is in the distant position and the pressing force imposed on the leaf spring portion 75A is reduced or eliminated. However, different configurations may be adopted.

For example, a stopper that delimits the extent of restoration of the sheet pressing member 75 may be provided, so that at least a portion of the sheet pressing member 75 configured to make contact with the document sheet is set by the stopper at a position retracted from the back surface of the separation pad 72 toward the back side thereof, when the holding member 17 is in the distant position.

Although, in the foregoing embodiments, the sheet conveying device according to an embodiment of the invention is applied to the automatic document feeder 7, the sheet conveying device may be applied to different devices, such as a sheet feeding device.

Although the sheet pressing member 75 includes the leaf spring portion 75A and the extending portion 75C in the forgoing embodiments, different configurations may be adopted. For example, the extending portion 75C may be excluded.

Although the ribs 17A are provided on the both sides of the sheet pressing member 75 in the width direction in the foregoing embodiments, the ribs 17A may be excluded.

In addition, although the second contact portion 73E is provided at the extending end of the pressing arm 73C in the foregoing embodiments, different configurations may be adopted. For example, the second contact portion 73E may be formed on a protruding end of a protrusion formed in the main body 73B, like the first contact portion 73D.

In the foregoing embodiments, the pressing member 73 and the elastic member 74 of the pressing mechanism are placed to oppose the separation roller 71 with the separation pad 72 interposed therebetween, and are configured to press the separation pad 72 against the separation roller 71. However, different configurations may be adopted.

Although the separation pad 72 is fixed to the holding member 17 in the foregoing embodiments, different configurations may be adopted. For example, the separation pad 72 may be fixed to the pressing member 73 swingably attached to the holding member 17.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being defined by the following claims.

What is claimed is:

1. A sheet conveying device comprising:

a roller configured to convey sheets in a sheet conveying direction;

a separation pad disposed opposite to the roller and configured to separate the sheets one by one, the separation pad comprising a first surface facing the roller;

a pressing mechanism disposed on an opposite side of the separation pad from the roller and configured to press the separation pad against the roller;

a roller pressing member comprising a roller contacting portion configured to contact and press the roller;

a holding member which holds the separation pad and the roller pressing member and is configured to move relative to the roller between a distant position and a close position in which the holding member is closer to the roller than in the distant position, wherein the pressing mechanism is configured to press the separation pad against the roller when the holding member is in the close position, and wherein the roller pressing member is configured such that when the holding member is in the distant position, at least the roller contacting portion of the roller pressing member is retracted from the first surface of the separation pad in a direction away from the roller.

2. The sheet conveying device according to claim 1, wherein the holding member comprises a pair of ribs extending toward the roller and opposite to each other in a width direction parallel to a rotation axis of the roller such that the roller pressing member is interposed between the pair of ribs, and wherein the holding member is configured such that when the holding member is in the distant position, roller-side ends of the pair of ribs are closer to the roller than the roller pressing member is to the roller.

3. The sheet conveying device according to claim 1, wherein the pressing mechanism comprises:

a pressing member comprising a first contact portion configured to contact a second surface of the separation pad, the second surface facing away from the roller; and an elastic member configured to press the first contact portion against the separation pad.

4. The sheet conveying device according to claim 1, wherein the roller pressing member comprises a leaf spring which is fixed, at an end thereof, to the holding member.

5. The sheet conveying device according to claim 3, wherein the pressing member of the pressing mechanism is configured to rotate about an axis parallel to a rotation axis of the roller and comprises a second contact portion configured to contact the roller pressing member, and wherein the pressing member is configured to rotate in a first direction, when the holding member moves from the distant position, such that the second contact portion projects relative to the roller to press the roller pressing member against the roller, and that the elastic member is compressed to apply a pressing force to the separation pad.

6. The sheet conveying device according to claim 5, wherein the pressing member of the pressing mechanism is configured to rotate in a direction opposite to the first direction, when the holding member moves from the close position to the distant position, such that the elastic member is decompressed, and that the second contact portion retracts relative to the roller to reduce a pressing force applied to the roller pressing member, and wherein the roller pressing member is configured to be restored, when the pressing force applied thereto is reduced, such that at least the roller contacting portion retracts from the first surface in the direction away from the roller.

7. The sheet conveying device according to claim 5, wherein when the holding member is in the close position, a first imaginary line, which passes through a contact point between the second contact portion and the roller pressing member and through the axis of the pressing member, is substantially perpendicular to a second imaginary line, which passes through the contact point between the second contact portion and the roller pressing member and through a point which corresponds to a contact point between the roller pressing member and the roller and lies on a back surface of the roller pressing member, the back surface facing away from the roller.

8. The sheet conveying device according to claim 5, wherein the pressing member of the pressing mechanism comprises a main body extending downstream in the sheet conveying direction from the axis of the pressing member, and a pressing arm extending from the axis of the pressing member to the second contact portion.

9. The sheet conveying device according to claim 8, wherein the main body of the pressing member comprises a protrusion protruding toward the separation pad and extending in a width direction parallel to the rotation axis of the roller, and the first contact portion is at a protruding end of the protrusion.

10. The sheet conveying device according to claim 8, wherein the sheet conveying device further comprises another roller pressing member configured to contact the roller, and the separation pad is interposed between the roller pressing member and the another roller pressing member in a width direction parallel to the rotation axis of the roller.

11. The sheet conveying device according to claim 10, wherein the pressing member of the pressing mechanism further comprises another second contact portion configured to contact the another roller pressing member, and another pressing arm extending from the axis of the pressing member to the another second contact portion, and the main body of the pressing member is interposed between the pressing arm and the another pressing arm in the width direction.

12. The sheet conveying device according to claim 1, wherein the roller pressing member comprises:

a leaf spring portion fixed, on an upstream side thereof in the sheet conveying direction, to the holding member and extending downstream in the sheet conveying direction, the leaf spring portion comprising the roller contacting portion formed on a downstream side thereof; and an extending portion which extends from the roller contacting portion in a direction which is away from the roller and crosses a direction in which the leaf spring portion extends.

13. The sheet conveying device according to claim 8, wherein the elastic member of the pressing mechanism comprises a coil spring disposed between the main body of the pressing member and the holding member.

14. The sheet conveying device according to claim 13, wherein one end of the coil spring in a compressing direction thereof is in contact with a central portion of the main body of the pressing member in a width direction parallel to the rotation axis of the roller, the central portion being opposite from the first contact portion, and the other end of the coil spring in the compressing direction is in contact with a central portion of the holding member in the width direction.

15. The sheet conveying device according to claim 1, wherein the roller pressing member and the separation pad are configured to move in opposite directions relative to the holding member when the holding member moves from the close position to the distant position.

16. The sheet conveying device according to claim 1, wherein the roller pressing member and the separation pad are configured to pivot in opposite directions when the holding member moves from the close position to the distant position.

17. The sheet conveying device according to claim 1, wherein the holding member holds the pressing mechanism.

* * * * *